United States Patent [19]

Flanagan

[11] Patent Number: 4,718,864

[45] Date of Patent: Jan. 12, 1988

[54] HIGH FREQUENCY COAXIAL CONNECTOR AND MOLDED DIELECTRIC BEAD THEREFOR

[75] Inventor: James R. Flanagan, New Britain, Conn.

[73] Assignee: Sealectro Corporation, Trumbull, Conn.

[21] Appl. No.: 891,738

[22] Filed: Jul. 30, 1986

[51] Int. Cl.[4] ..... H01R 17/18

[52] U.S. Cl. ..... 439/578; 439/933

[58] Field of Search ..... 339/177 R, 177 E, 143 R, 339/89 C, 90 C, 218 R, 218 M; 333/260, 261

[56] References Cited

U.S. PATENT DOCUMENTS

| | | | |
|---|---|---|---|
| 3,229,234 | 1/1966 | Lattanzi | 333/261 |
| 3,492,605 | 1/1970 | Ziegler, Jr. | 333/260 |
| 4,431,255 | 2/1984 | Banning | 339/177 E |

FOREIGN PATENT DOCUMENTS

| | | | |
|---|---|---|---|
| 3033690 | 3/1982 | Fed. Rep. of Germany | 339/177 R |
| 664271 | 11/1965 | France | 339/177 R |
| 1490421 | 11/1977 | United Kingdom | 339/177 R |

*Primary Examiner*—Gil Weidenfeld
*Assistant Examiner*—David Pirlot
*Attorney, Agent, or Firm*—Anthony J. Casella; Gerald E. Hespos

[57] ABSTRACT

A high frequency coaxial connector capable of operating up to 40 GHz includes inner and outer conductors which are maintained in spaced relationship by an injection molded, dielectric support bead which is cylindrical, is formed of a plastic material, and is of uniform density. The inner contact is press fit into a central hole in the support bead, and the latter is press fit into the outer contact. The support bead further includes an array of apertures concentrically disposed about the central aperture and disposed parallel to said central aperture. The opposed generally parallel faces of the support bead may be provided with an annular undercut portion which intersects the array of parallel apertures. By this construction, the center contact is supported by the injection molded dielectric support bead in a manner to enable the coaxial connector to operate at high frequencies.

5 Claims, 6 Drawing Figures

HIGH FREQUENCY COAXIAL CONNECTOR AND MOLDED DIELECTRIC BEAD THEREFOR

BACKGROUND OF THE INVENTION

Coaxial cables are formed from an inner conductor and an outer conductor concentrically disposed around the inner conductor, with a nonconducting insulation being uniformly disposed therebetween. Coaxial cables are used to carry radio frequency or microwave frequency electrical signals.

Coaxial connectors are employed to join one coaxial cable to another or to join a coaxial cable to an appropriate electrical circuit such as a circuit board, a microstrip, a coplanar wave guide or the like. The coaxial connector enables the structural and electrical mating of the outer conductor of the socket to the outer connector of the plug, and also the inner connector of the socket to the inner connector of the plug. The inner conductor of the coaxial connector typically is of very smaller diameter and extends a longitudinal distance that is great compared to the small diameter. For example, a widely accepted standard for sub-miniature coaxial connectors (SMA connectors) provides a male pin having a diameter of 0.036–0.037 inch. The female socket to which this male pin will be mated typically will have an external dimension of only 0.0495–0.0505 inch. In view of these relatively small dimensions, it is necessary to provide a support between the inner and outer conductors of both plug and socket members to assure the coaxial symmetry of each member. This support typically is provided by a non-conducting, insulating material, such as a plastic bead which is concentrically disposed between the inner and outer conductors and which provides the necessary concentric support therebetween. The plastic bead typically is formed form a dielectric material such as polyphenylene oxide. The dielectric support bead must be precisely manufactured to be nearly perfectly concentric relative to the inner and outer conductors. Any nonconcentricity or any burrs, nicks or the like which may occur during manufacturing will invariably affect the electrical performance characteristics of the connector by causing losses to occur under certain operating conditions or at certain frequency ranges. Similar problems will occur if the dielectric material from which the bead is formed is of nonuniform density throughout.

All dielectric support beads create an impedance regardless of the precision with which they are manufactured. This impedance is proportional to the dielectric constant of the support bead. The dielectric constant, in turn, is inversely proportional to the radio frequency at which the connector is capable of operating. More particularly, a support bead having a low dielectric constant will be able to operate at higher frequencies. The typical prior art SMA coaxial connector operates at or below 26 GHz.

There have been ongoing attempts to develop coaxial connectors that can reliably carry frequency signals greater than 26 GHz. Furthermore, there is a particular desirability of providing a coaxial connector that can perform at very high frequencies and that is both mechanically and electrically compatible with the widely used SMA connectors. In particular, it would be desirable to produce a connector that is compatible with SMA connectors and that can reliably accommodate frequencies up to and above 40 GHz and that also will match or exceed the electrical performance of the standard SMA connectors at lower frequencies, such as frequencies below 26 GHz, as well as the mechanical performance of the standard SMA connectors.

The dimensions of the standard SMA connector severely limit the options that are available for developing a dimensionally compatible connector with much higher frequency limits. More particularly, since the dimensions of any new high performance connector must be compatible with the dimensions of the known SMA connectors the only significant improvements in performance can be achieved by providing an improved dielectric bead and by providing a high frequency connector that will be less susceptible to contamination. Improvements in the performance of the dielectric bead would require decreasing the dielectric constant of the support bead so that higher frequencies can be obtained. This objective, however, cannot easily be achieved because the support bead of an SMA connector typically has a diameter of 0.160 inch or less and an average length of approximately 0.235 inches. Furthermore, any structure to reduce contamination within the connector, such as contamination caused by moisture or by the flaking of the gold plated members of the connector, presumably would adversely affect the performance of the connector.

Recently, it has been theorized that the dielectric constant of the support bead could be decreased by providing a generally symmetric array of longitudinally aligned apertures through the bead, thereby reducing the amount of dielectric material and thus reducing the overall dielectric constant. This decrease in the dielectric constant would in theory enable the connector to operate at higher frequency levels. In operation, it was believed that the dielectric bead could be manufactured from an elongated extruded rod of the selected plastic dielectric material. The rod would first be drilled with a central aperture, and the free end of the rod would be machined with an annular channel. The length of the rod would then be machined down to the required outside diameter of the dielectric bead. A section of the rod would then be cut off to the required length of the dielectric support bead, and an annular channel would then be machined into the opposed end of the bead, with the dimensions of both annular channels being selected to create compensation steps required to compensate for the stepped configurations of portions of the inner or outer connector body in which the dielectric bead is mounted. Finally, a plurality of longitudinally extending apertures would be drilled entirely through the support bead between the central aperture and the outer circumference. Attempts to manufacture support beads of this type at a production scale proved entirely unacceptable. More particularly, it was found that variations in the temperature at the extrusion head which produced the rod from which the beads would be formed resulted in slightly different densities along the length of the rod. Consequently, the impedance characteristics often would differ from one bead to the next or would be variable across any given bead. Additionally, all of the plastic materials from which the support bead might be formed are somewhat resilient and cannot be manufactured at production rates to the required accuracy, and furthermore such plastic materials have a "memory" thereby possibly resulting in distortion of the resulting bead when machined during manufacturing. These problems inherent to plastics were exacerbated by the very small size of the bead and by the small webs existing between the apertures formed in the bead. As a result, the beads would structurally vary from the specifications with corresponding degradations in anticipated performance.

Additionally, the bead described above did not adequately protect against microscopic contamination, such as contamination from gold flakes or moisture. This contamination could offset a substantial part of the improvements that were believed to be attainable with the suggested configuration. Extensive inquiries to manufacturers of plastic components indicated that the machining manufacturing process, with its various drawbacks, was the only option in view of the small size, the material requirements and the very high precision required for the bead dimensions, corners and apertures.

In view of the above, it is an object of the subject invention to provide a high frequency coaxial connector that can efficiently perform at frequencies up to or above 40 GHz.

Another object of the subject invention is to provide a high frequency coaxial connector that is mechanically and electrically compatible with existing sub-miniature standards for coaxial connectors.

A further object of the subject invention is to provide a support bead for a high frequency coaxial connector capable of efficiently operating at frequencies up to 40 GHz.

An additional object of the subject invention is to provide a molded support bead for a high frequency coaxial connector having a plurality of apertures extending longitudinally at least partly therethrough.

Still a further object of the subject invention is to provide a high frequency coaxial connector with a substantially reduced probability of contamination.

SUMMARY OF THE INVENTION

The high frequency coaxial connector of the subject invention may take the form of either a plug or a socket and comprises concentrically disposed inner and outer contact members defining a generally tubular body. Concentrically disposed between the center contact and the tubular body is an injection molded dielectric support bead. More particularly, the molded dielectric support bead includes a centrally disposed through aperture of circular cross section having a diameter less than the outer diameter of the center contact to form an interference fit therewith. The support bead is further defined by a cylindrical outer surface having a diameter greater than the inner diameter of the generally tubular body which defines the outer contact. The inner and outer diameters of the dielectric support bead are manufactured very precisely to enable the dielectric support bead to be press fit over the center contact and to be press fit within the body. The injection molding of the dielectric support bead provides a structure of uniform density throughout, with well defined corners, and with no flashing or seams where movable portions of the mold join. The support bead may be provided with a central aperture defining a diameter of 0.0354+/−0.0005 inch, and an outer diameter of 0.1205+/−0.0005 inch to enable the dielectric bead and the connector to be compatible with the prior art sub-miniature standardized connector dimensions. Preferably, the molded dielectric support bead will be concentric to within 0.001 inch.

To enable the required reduction in the dielectric constant and thereby to increase the frequencies at which the subject connector is operable, the molded dielectric support bead is provided with an array of peripheral apertures extending at least partly therethrough in a longitudinal direction. More particularly, the peripheral apertures are of uniform size relative to one another and are symmetrically disposed about the dielectric support bead. In a preferred embodiment, the molded dielectric support bead is provided with six apertures angularly spaced from one another by 60°.

The opposed generally parallel faces of the dielectric bead may be at least partly undercut by an amount which creates a carefully controlled conpensation step which results in an impedance change to compensate for the stepped configurations of portions of the outer or inner connector body in which the dielectric support bead is mounted.

In embodiments of the subject connector where contamination can be controlled and where extremely high frequencies on the order of 40 GHz or more are required, it is preferred that all of the apertures in the dielectric support bead extend entirely therethrough. On the other hand, in embodiments of the connector where somewhat lower frequencies can be tolerated and where contamination must be avoided, the dielectric support bead may be shrouded at one longitudinal end thereof. More particularly, in the alternate embodiment of the subject invention, the apertures disposed between the central through aperture and the outer circumference of the dielectric support bead do not extend entirely therethrough. Rather, these apertures will extend into one end but will terminate a short distance from the opposed end of the face of the dielectirc support bead. The closed end of the dielectric support bead will be positioned to face the exposed portion of the connector. As a result, contaminants cannot work their way through the dielectric support bead and into the internal portion of the high frequency coaxial connector.

As noted above, one type of contaminant consists of microscopic gold flakes which become separated from the gold plated portions of the contacts. Specifically, it has been found that the gold flaking tends to accumulate at portions of the contacts defined by intersecting surfaces such as at corners or within the threaded portions. When the coaxial plug is mated with a coaxial socket, these gold plated portions will be urged into one another and microscopic flakes will be separated from one or both contacting members. This flaking has been found to occur most often at the corners and where to plane surfaces intersect. To avoid this particular type of contaminant, the male pin of the center contact of the subject invention is provided with a spherical tip with a smooth blend radius which joins the cylindrical portion of the pin. Similarly, the female socket of the center contact of the subject invention is provided with a smooth blend radius at the pin entry surface. As a result, the problem of gold flaking that had been heretofore prevalent at intersecting surfaces is substantially reduced or eliminated, with a corresponding decrease in contaminants within the connector. It is preferred that this pin and socket construction be employed with both the subject coaxial connector having a dielectric support bead with through apertures, and the embodiment of the subject coaxial connector having a shrouded dielectric support bead.

DETAILED DESCRIPTION OF THE PREFERRED EMBODIMENTS

Figure 1:
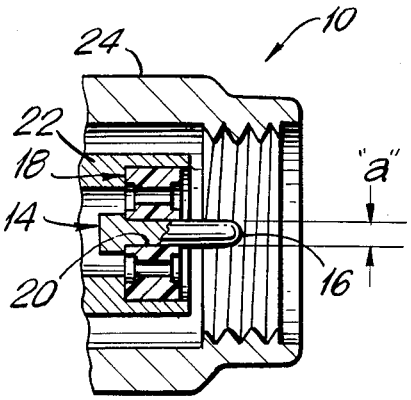
FIG. 1 is a cross-sectional view of a coaxial connector plug according to the subject invention.
Figure 2:
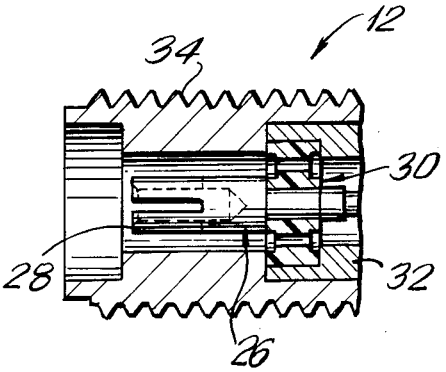
FIG. 2 is a cross-sectional view of a coaxial connector socket according to the subject invention.

A high frequency coaxial connector plug according to the subject invention is illustrated in FIG. 1 and is indicated generally by the numeral 10. A compatible coaxial connector socket according to the subject invention is illustrated in FIG. 2. and is indicated generally by the numeral 12. With reference to FIG. 1, the coaxial connector plug 10 is provided with a center contact pin 14 aligned along the centerline of the connector 10. The center contact pin 14 has a diameter "a" which preferably equals 0.036 inch to render the coaxial connector plug 10 compatible with the standard SMA connectors. The coaxial connector pin 14 is further provided with a spherical tip 16 having a diameter "a" and formed to define a smooth blend radius with the cylinderical outer surface of the center contact pin 14. Thus, the cylindrical surface defined by the center contact pin 14 is tangent to the spherical tip 16.

The center contact pin 16 is concentrically surrounded by and is press fit within a dielectric support bead 18. More particularly, the dielectric support bead 18 is of cylindrical configuration with a central through bore 20 which is dimensioned to be slightly expanded as it is urged into concentric relationship with the center contact pin 14. The specific construction of the dielectirc support bead 18 is explained in greater detail below. However, with continued reference to FIG. 1, the dielectric support bead 18 of the coaxial connector plug 10 is disposed within body 22 which, in turn, is disposed within coupling nut 24; the body 22 being the outer conductor of the high frequency coaxial connector plug 10. The body 22 and coupling nut 24 both are concentrically disposed around the centerline of the coaxial connector plug 10. Furthermore, the dielectric support bead 18 is press fit into body 22.

Turning to FIG. 2, the coaxial connector socket 12 comprises a center contact socket 26 having a female socket end 28 which is dimensioned to biasingly engage the center contact pin 14. The end 28 of the contact socket 26 is configured to have a smooth blend radius at its internal pin entry surface so as to eliminate any sharp corner or edge which would result in an accumulation of gold flakes during plating, thereby eliminating a source of possible contaminants. The center contact socket 26 is press fit within a dielectric support bead 30 which preferably is identical to the dielectric support bead 18 shown in FIG. 1. This identify enables the respective parts to be interchanged thereby greatly facilitating the assembly of both the coaxial connector plugs 10 and the coaxial connector sockets 12. The dielectric support bead 30 shown in FIG. 2 is press fit into a bead holder 32 which in turn is press fit within a body 34. The coaxial connector plug 10 shown in FIG. 1 is engageable with the coaxial connector socket 12 shown in FIG. 2 by threadably engaging the coupling nut 24 of the connector 10 with the body 34 of connector 12. This threaded interconnection will enable the center contact pin 16 of connector 10 to be engaged by the center contact socket 26 of connector 12.

Figure 3:
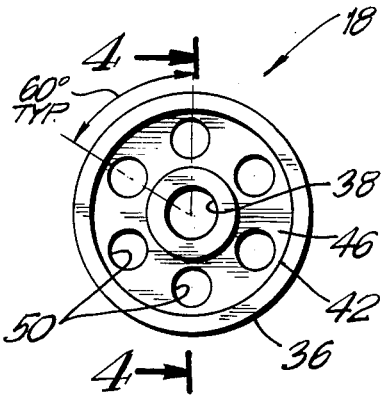
FIG. 3 is a front elevational view of the preferred embodiment of the dielectric support bead of the subject invention.
Figure 4:
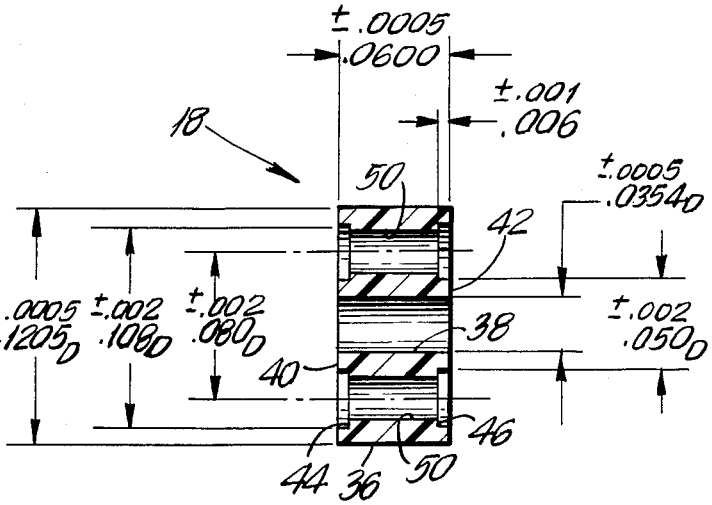
FIG. 4 is a cross-sectional view of the molded dielectric support bead taken along line 4—4 in FIG. 3.

The dielectric support bead 18 (30) of connector 10 (12) is illustrated more clearly in FIGS. 3 and 4. More particularly, the dielectric support bead 18 includes a cylindrical outer surface 36, a cylindrical inner surface 38, and opposed surface ends 40 and 42. The outer cylindrical surface 36 defines a diameter of 0.1205 inch+/−0.0005 inch. The cylindrical inner surface 38 defines a diameter of 0.0354 inch+/−0.0005 inch. The outer and inner cylinderical surfaces 36 and 38 are concentric with one another to within 0.001 inch. The opposed faces or ends 40 and 42 are parallel to one another. Additionally, the opposed ends 40 and 42 are provided with undercut portions 44 and 46, respectively, which define a compensation step which results in an impedance change to compensate for the stepped configuration of the body 22 of the connector.

As explained above, to achieve operation at the desired frequency ranges of 40 GHz or more, and also to maintain mechanical and electrical compatibility with the standard existing sub-miniature connectors, it is necessary to reduce the dielectric constant of the subject support bead 18. This has been accomplished by providing an array of apertures 50 which extend parallel to the axis of the dielectric support bead 18. More particularly, as shown most clearly in FIG. 4, the dielectric support bead 18 is provided with an array of six apertures 50 which are spaced from one another by 60°. Each aperture 50 has a diameter of 0.0240 inch+/−0.001 inch. The centerline to centerline distance between the apertures 50 which are 180° apart from one another is 0.080 inch+/−0.002 inch, as shown in FIG. 3.

As noted above, the ability of the subject connector to perform well at high frequencies depends both upon achieving a lower dielectric constant and also upon the ability to manufacture the support bead 18 with extreme precision. The dimensional tolerances indicated in FIGS. 3 and 4 cannot reliably be achieved by standard machining practices. In the subject invention, the dielectric support bead 18 is formed by injection molding. Preferably, the dielectric support bead 18 is formed from a polyphenylene oxide such as the plastic material sold under the trade name NORYL. The central aperture and the peripheral apertures can be formed by employing an injection mold having a plurality of movable pins disposed therein in the positions corresponding to each of the apertures. After the plastic materials has appropriately set, the pins are withdrawn and the remainder of the mold is opened to remove the completed dielectric support bead. In view of the fact that the peripheral apertures 50 are not being machined, but rather are being formed by longitudinally movable pins in the injection mold, it is not essential that the apertures 50 be round, as illustrated in FIGS. 3 and 4. Rather, some other configuration symmetrical with respect to the centerline of the support bead 18 may be employed, and depending upon the particular application could further reduce the dielectric constant of the support bead 18.

Figure 5:
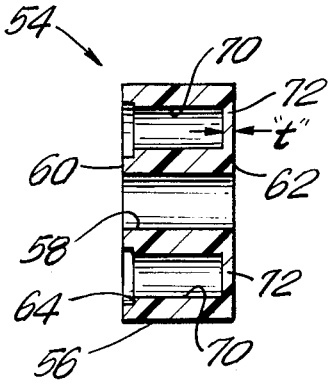
FIG. 5 is a cross-sectional view of an alternate embodiment of the molded dielectric support bead of the subject invention.

In embodiments of the subject connector where protection against microscopic contamination is especially important, an alternate support bead 54 is provided as illustrated in FIG. 5. The support bead 54 incldues a cylindrical outer surface 56 and a cylindrical inner surface 58 which may be formed to the same dimensions and precision as the support bead 18, described above and illustrated in FIGS. 3 and 4. Similarly, the support bead 54 includes opposed end faces 60 and 62. The end 60 is provided with a conpensation step 64 similar to the compensation step 44 on the support bead 18. The support bad 54 also is provided with an array of peripheral apertures 70 aligned parallel to the centerline of the support bead 54 and disposed symmetrically thereabout. However, unlike the apertures 50 in support bead 18, the apertures 70 in support bead 54 do not extend the entire distance through support bead 54. Rather, a shroud portion 72 is defined in line with each aperture 70 at end 62 of support bead 54. The shroud portion preferably has a thickness "t" equal to 0.005 inch+/−0.001 inch.

Figure 6:
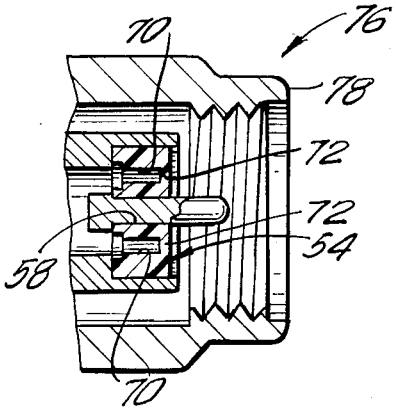
FIG. 6 is a cross-sectional view of a coaxial connector plug incorporating the molded dielectric support bead as illustrated in FIG. 5.

As shown in FIG. 6, the bead 54 is positioned in a connector 76 such that the shroud portions 72 are aligned at the connecting end 78 of connector 76. As a result, the shroud portions 72 effectively prevent microscopic contaminants from entering the connector 76. However, a substantial portion of the dielectric support bead has been removed by the peripheral apertures 70 therein. Although the connector 76 with the shrouded dielectric support bead 58 will enable operation at frequencies higher than the prior art connectors, it generally will not be possible to achieve the same broad band performance enabled by the connectors 10 or 12 described above with support beads having peripheral apertures extending entirely therethrough.

The shrouded support bead 54 preferably is manufactured by an injection molding technique described above, although it can also be manufactured by a machining process for certain applications. More particularly, the shrouded support bead 54 is preferably formed in an injection mold having movable pins to define the apertures 70 therein. However, the movable pins will not extend a sufficient distance to define through apertures. Rather, the movable pins will stop short of one end of the mold by a distance "t" corresponding to the thickness of the shroud portions 72, as explained above.

In summary, a high frequency coaxial connector is provided including a molded dielectric support bead. The dielectric support bead is injection molded to provide a through aperture, and a plurality of peripheral apertures parallel to and disposed symmetrically about the central through aperture. In certain preferred embodiments, the peripheral apertures extend entirely through the dielectric support bead with the net effect of substantially reducing the dielectric constant thereof. In these embodiments, the connector is capable of operating at frequencies in excess of 40 GHz. In embodiments where lower frequencies can be tolerated and where protection from contaminants is more critical, the peripheral apertures in the dielectric support bead do not extend entirely therethrough. Tather, one end of the electric support bead is shrouded and defines a continuous face surface. The dielectric support bead then is positioned in the connector such that the shrouded end thereof is adjacent the open end of the connector. Contaminants can further be reduced by forming the center contact pin with a spherical tip and a smooth blend radius. Similarly, the center contact socket is provided with a smooth blend radius at the pin entry surface. These confifgurations will prevent the accumulation of gold plating material that could ultimately lead to flaking of the gold plated material which in its flaked condition would define a contaminant that may adversely affect the performance of the connector.

While the invention has been defined with respect to several preferred embodiments, it is apparent that various modifications can be made the spirit and scope of the invention as defined by the appended claims.

What is claimed is:

1. An injection molded dielectric support bead for use in a high frequency electrical connector, said injection molded dielectric support bead being formed from a plastic material and being of uniform density, said injection molded dielectric support bead being of cylindrical configuration including first and second parallel end faces and a central aperture extending therethrough, said injection molded dielectric support bead further including an array of apertures extending through said first end face and disposed concentrically about the central aperture, each aperture of said array of apertures extending a major portion of the distance between said first and second end faces of said injection molded dielectric support bead but terminating short of the second end thereof to define a continuous shroud at the second end of said dielectric support bead, said apertures in said array of apertures being parallel to the central aperture thereof, said bead further comprising an undercut portion at the first end thereof concentric with said central aperture and aligned with the ends of the apertures in said array of apertures.

2. An injection molded dielectric support bead as in claim 1 wherein the array of apertures includes six annular apertures.

3. A high frequency coaxial connector having a mated end for connection to a mating connector and having an opposed end, said high frequency coaxial connector comprising:

a center contact one end of which is free and generally at the mating end of said high frequency coaxial connector for engagement with said mating connector;

an outer contact spaced from said center contact and disposed centrally thereabout; and an injection molded dielectric bead formed of plastic material and being of uniform density, said support bead being of cylindrical configuration including first and second parallel end faces and a central through aperture, said support bead further including an array of apertures extending through said first end face and disposed concentrically about said central through aperture, each aperture of said array of apertures extending a major portion of the distance through said support bead and being parallel to the central through aperture thereof, said injection molded dielectric bead further comprising an annular undercut portion in said first end concentric with said central aperture and aligned with the ends of the apertures in said array of apertures, said support bead being disposed between said center contact and the outer contact such that the second end of said support bead faces the mating end of said high frequency coaxial connector with the center contact extending through and press fit into the central through aperture of the support bead, and with the free end of the center contact extending beyond the second end face of said bead, whereby said second end face of said support bead prevents contaminants from entering the high frequency coaxial connector, and whereby the array of apertures surrounding said central aperture substantially reduces the dielectric constant of the bead.

4. An injection molded dielectric support bead as in claim 1 wherein the apertures in said array of apertures terminate at a location spaced from said second end of said bead by a distance of approximately 0.005 inch.

5. A connector as in claim 3 wherein the apertures in said array of apertures of said bead terminate at a location spaced from said second end of said bead by a distance of approximately 0.005 inch.

* * * * *